US010143073B2

(12) United States Patent
Fietzek et al.

(10) Patent No.: US 10,143,073 B2
(45) Date of Patent: Nov. 27, 2018

(54) CONTROL ALGORITHM FOR AN ELECTRONIC DIMMING BALLAST OF A UV LAMP

(71) Applicant: XYLEM IP MANAGEMENT S.à r.l., Senningerberg (LU)

(72) Inventors: Reiner Fietzek, Herford (DE); Dirk Riepe, Herford (DE)

(73) Assignee: XYLEM IP MANAGEMENT S.a r.l., Senningerberg (LU)

( * ) Notice: Subject to any disclaimer, the term of this patent is extended or adjusted under 35 U.S.C. 154(b) by 0 days.

(21) Appl. No.: 15/701,631

(22) Filed: Sep. 12, 2017

(65) Prior Publication Data

US 2018/0077784 A1 Mar. 15, 2018

(30) Foreign Application Priority Data

Sep. 13, 2016 (EP) ..... 16188575

(51) Int. Cl.
*H05B 41/392* (2006.01)
*H05B 1/02* (2006.01)
(Continued)

(52) U.S. Cl.
CPC ..... *H05B 41/3927* (2013.01); *H05B 1/0244* (2013.01); *H05B 33/06* (2013.01); *H05B 41/2988* (2013.01)

(58) Field of Classification Search
CPC .. H05B 41/3927; H05B 1/0244; H05B 33/06; H05B 41/2988
(Continued)

(56) References Cited

U.S. PATENT DOCUMENTS 4,394,603 A * 7/1983 Widmayer ..... H05B 41/42 315/105
5,910,709 A 6/1999 Stevanovic et al.
(Continued)

OTHER PUBLICATIONS

Extended European Search Report for European Application No. 16188575.1-1802, dated Mar. 8, 2017—6 Pages.

*Primary Examiner* — Daniel D Chang
(74) *Attorney, Agent, or Firm* — RatnerPrestia

(57) ABSTRACT

A control algorithm for operating a fluid disinfecting system by UV radiation, wherein the UV radiation is generated by at least one UV lamp including a pair of heating cathodes having a discharge voltage ($U_D$), the UV lamp is operated by an electronic ballast unit equipped with the control algorithm for adjusting the UV power of the UV lamp by pulse-width-modulation to reduce UV power. The control algorithm decreases the current to a level ($I_{kmin}$), increases the voltage amplitude (U) above the discharge voltage ($U_D$) until a desired UV power level is reached. The pulse width (PW) is decreased with increasing voltage amplitude (U) until $PW_{min}$ is reached. The decrease in current and the increase in voltage generate an ineffective current-voltage-ratio in which excess current heats the cathode. An electronic ballast equipped with the algorithm and systems equipped with such ballasts are also disclosed.

19 Claims, 3 Drawing Sheets

(51) Int. Cl.
*H05B 33/06* (2006.01)
*H05B 41/298* (2006.01)

(58) Field of Classification Search
USPC ..... 315/98
See application file for complete search history.

(56) References Cited

U.S. PATENT DOCUMENTS

| | | | | |
|---|---|---|---|---|
| 6,121,734 | A * | 9/2000 | Szabados ..... | H05B 41/3927 315/209 R |
| 8,593,078 | B1 | 11/2013 | Xiong | |
| 2002/0017881 | A1 * | 2/2002 | Szabados ..... | H05B 41/3921 315/312 |
| 2009/0273299 | A1 | 11/2009 | Gawrys et al. | |

* cited by examiner

CONTROL ALGORITHM FOR AN ELECTRONIC DIMMING BALLAST OF A UV LAMP

CROSS REFERENCE TO RELATED APPLICATIONS

This application claims priority to European Application No. 16188575.1, filed Sep. 13, 2016, the contents of such applications being incorporated by reference herein.

FIELD OF THE INVENTION

The present invention relates to a control algorithm for operating a fluid disinfecting system.

BACKGROUND OF THE INVENTION

The antimicrobial action of ultraviolet (UV) radiation is well known. A drawback of existing systems resides in the power consumption and limited lifespan of UV lamps. In order to address this, it is desirable to provide a means to control the intensity of the UV lamp, in order that the lamp intensity may be attenuated adapted to the status of the system.

Low-pressure UV lamps used in disinfection plants comprise a pair of heating filaments or cathodes at either end. A supplied voltage is utilized to heat the cathodes up to a temperature at which an emission of electrons occurs. These electrons can then be used to initiate a glow discharge across the tube causing the gas to radiate by applying a high voltage across the two cathodes. Commonly, an electronic dimmer circuit linked to the UV lamp is used to control its intensity.

It is known that UV lamp cathodes should be pre-heated in order to start the lamp, as explained above. Pre-heating increases the so-called thermionic emission of electrodes, which is enhanced by a suitable surface coating of the cathodes. At too low temperatures, the emission of electrodes necessitates higher voltages, which in turn results in a damage of the coating and hence in a damage of the UV lamp itself.

Pre-heating protects the cathodes and prolongs the lifespan of the UV lamp. In addition it has been shown, that during operation the temperature of the cathodes should remain elevated. Otherwise cathode material is damaged if the temperature of the cathodes is too low. Nowadays, dimming ranges up to 90% are reached, resulting in a lamp output of only 10% of the nominal power output. The parameters of the electric energy to drive lamps under dimmed conditions are usually optimized in a way that the efficiency of the UV light production in terms of radiation output versus power input is optimized. Parameters are voltage, current and pulse length or duty cycle in case of pulse-width modulation. The current under dimmed conditions is so low that it does not generate enough heat when passing the cathodes. Thus to minimise damage to the cathodes, additional heat sources are used, that prevent a cool-down of the cathodes. The drawback of this is, that additional heat sources are complex and costly.

SUMMARY OF THE INVENTION

It is an objective of the present invention to provide a control algorithm for operating a fluid disinfecting system with a UV lamp which is less complex and which keeps the cathodes of the UV lamps at a sufficient temperature when operated at reduced power output.

This problem is solved by a control algorithm for operating a fluid disinfecting system. Accordingly, a control algorithm for operating a fluid disinfecting system by means of UV radiation is provided, wherein the UV radiation is generated by at least one UV gas discharge lamp comprising a pair of heating cathodes having a minimum discharge voltage, said UV lamp is operated by an electronic ballast unit, which is equipped with the control algorithm, which allows to adjust the operating parameters of the UV lamp, especially by using pulse-width-modulation to reduce UV power, said control algorithm being adapted to at least control the parameters current, voltage and pulse width or length, including the following steps for reducing the UV output power:

- Decreasing the current to a level;
- Increasing the voltage amplitude to more than the minimum discharge voltage until a desired UV power level is reached;
- With increasing voltage amplitude decreasing the pulse width, until $PW_{min}$ is reached;
- Wherein the decrease in current and the increase in voltage are carried out in such a way, that an ineffective current-voltage-ratio is generated, whereas the too high current is used for cathode heating.

The following variables are used:

- $PW_{min}$ is the pulse width for operating the UV lamp in an ineffective mode;
- $I_{kmin}$ is the current for operating the UV lamp in an ineffective mode. Note that $I_{kmin}$ is higher than the usual operating current which is used in operating the UV lamp at the highest possible efficiency;
- $U_{kmin}$ is the voltage for operating the UV lamp in an ineffective mode; and
- $U_D$ is the minimum voltage required for maintaining the gas discharge.
- "Ineffective" in this context means that the UV lamp is operated outside the optimum operating status. In the above case the current is too high and can not be fully utilized for UV generation. Part of the current heats the cathode.

Technically, the parameters are varied in the way that the UV output remains essentially constant within the usual limits of variation in this kind of control process, and that the electric power input is increased. This process makes the operation of the lamp ineffective in the sense that the efficiency of UV light production versus electric power consumption decreases. Thus, more electric energy is converted into heat in order to keep the operating temperature at a desired level. It is an unusual measure to deliberately vary the parameters of operating a UV lamp such that the efficiency is decreased.

In this way part of the energy is used to heat the cathodes, which prolongs the lifespan of the UV lamp without the need of an additional heat source.

Preferably, the operating voltage of the UV lamps has a frequency between 40 kHz and 80 kHz and even more preferably of about 65 kHz.

The voltage amplitude can be during a major part of the pulse width 110% to 180% of the discharge voltage and even more preferably, 135% to 150%.

Advantageously, the UV lamp is a low-pressure UV lamp and/or the fluid is drinking water or treated wastewater.

A preferred embodiment of the present invention will be described with reference to the drawings. In all figures the same reference signs denote the same components or functionally similar components.

DETAILED DESCRIPTION

Figure 1:
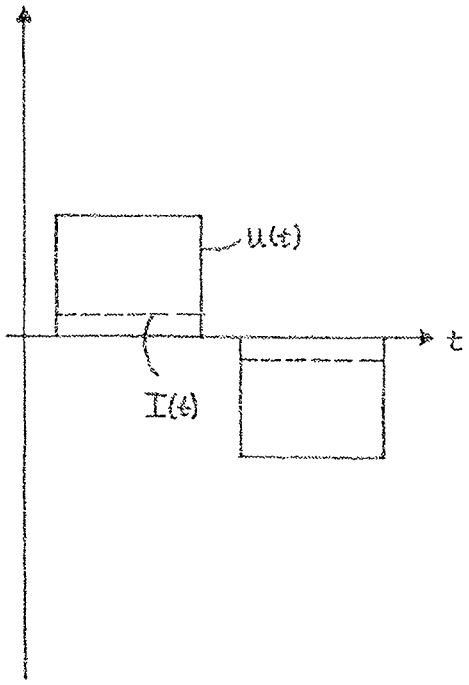
Figure 1 PRIOR ART
FIG. 1 shows a schematic illustration of a prior art voltage and current curve generated by a ballast unit for a UV module with a plurality of UV lamps.
Figure 3:
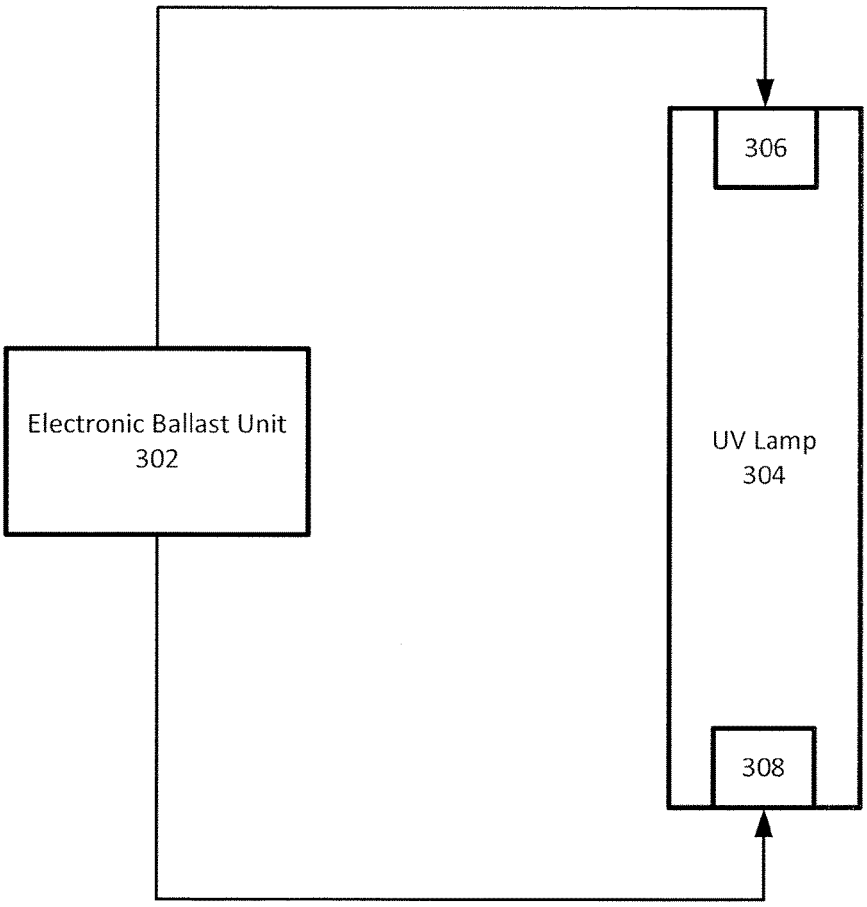
FIG. 3 shows a block diagram of a UV lamp controlled by an electronic ballast according to the present invention.

An electronic ballast unit 302 (see FIG. 3) for a UV radiator like a low voltage gas discharge UV lamp 304 (see FIG. 3) preheats the coils of the lamp prior to starting the gas discharge, and generates an ignition voltage to start the discharge. The power of the connected UV radiator is automatically controlled by a pulse-width modulation. It is driven by a pulse-shaped voltage obtained from rectified AC (see FIG. 1). The example of FIG. 1 shows a dimmed operation with a UV power output and a corresponding electric energy input of 30% of the nominal power rating of the lamp. However, the cathodes 306/308 (see FIG. 3) are constructed for 100% nominal power at which a predetermined cathode temperature is generated. At 30% of the nominal power the cathodes are too cold, which negatively affects the service life time of the UV lamps.

Figure 2:
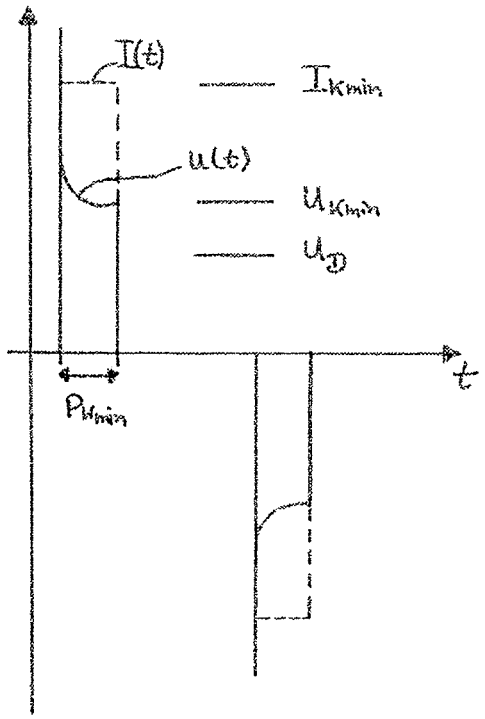
FIG. 2 shows a schematic illustration of a voltage and current curve according to the present invention.

FIG. 2 shows the change in voltage and current over time according to the present invention. The output current I and voltage U have an essentially rectangular shape with a frequency of around 65 kHz. The current signal I and voltage signal U have almost the same shape, because a commonly used choke is not present. The power or rather the effective current I is controlled by pulse width modulation (PWM).

During rated operation the voltage amplitude should be equal to the lamps' discharge voltage $U_D$. If the burn voltage U is higher than the discharge voltage $U_D$, hardly more UV power is produced; rather energy is lost by heat generation.

As shown in FIG. 2, at the beginning of a pulse the voltage increases for a short time until it decreases to a predefined level $U_{kmin}$ for the rest of the pulse length, creating a sharp peak followed by a plateau. The given current $I_{kmin}$ leads to a drop of the operating voltage U to $U_{kmin}$. This mode generates an ineffective current-voltage-ratio, wherein the too high current is used for cathode heating.

The electronic ballast unit is preferably equipped with two control algorithms. The control variable is UV power. To reduce UV power, the current is decreased to $I_{kmin}$ and held at this level. After that the voltage amplitude is increased until the desired UV power is reached. With increasing voltage amplitude the pulse width decreases, until $PW_{min}$ is reached.

The intermediate voltage circuit is preferably designed in such a way that the desired voltage range is given without hardware modification.

In order to reach 30% UV power with acceptable electrode heating, in one embodiment the pulse width is 35% of rated operation and the voltage amplitude is 40% higher.

The invention claimed is:

1. A method for controlling operation of a fluid disinfecting system by means of UV radiation, wherein the UV radiation is generated by at least one UV lamp comprising a pair of heating cathodes having a discharge voltage ($U_D$), said UV lamp operated by an electronic ballast unit equipped with a control algorithm for adjusting UV power of the UV lamp by pulse-width-modulation to reduce UV power, the method comprising using the control algorithm of the electronic ballast unit to perform the steps of:

decreasing a current generated by the electronic ballast unit to a level ($I_{kmin}$);

increasing a voltage amplitude (U) generated by the electronic ballast unit above the discharge voltage ($U_D$) until a desired UV power level is reached; and with increasing the voltage amplitude (U) decreasing a pulse width (PW) generated by the electronic ballast unit, until $PW_{min}$ is reached, wherein decreasing the current and increasing the voltage amplitude (U) generates an ineffective current-voltage-ratio in which excess current heats the cathode.

2. The method of claim 1, wherein the operating voltage of the UV lamps has a frequency between 40 kHz and 80 kHz.

3. The method of claim 1, wherein the operating voltage of the UV lamps has a frequency of about 65 kHz.

4. The method of claim 1, wherein the voltage amplitude (U) is 110% to 180% of the discharge voltage ($U_D$) during a major part of the pulse width.

5. The method of claim 1, wherein the voltage amplitude (U) is 135% to 150% of the discharge voltage ($U_D$) during a major part of the pulse width.

6. The method of claim 1, wherein the at least one UV lamp is a low-pressure UV lamp.

7. The method of claim 1, wherein the fluid is drinking water or treated wastewater.

8. The method of claim 1, wherein the operating voltage of the UV lamps has a frequency between 40 kHz and 80 kHz, the voltage amplitude (U) is 110% to 180% of the discharge voltage (UD) during a major part of the pulse width.

9. The method of claim 1, wherein the operating voltage of the UV lamps has a frequency of about 65 kHz and the voltage amplitude (U) is 135% to 150% of the discharge voltage (UD) during a major part of the pulse width.

10. The method of claim 8, wherein the at least one UV lamp is a low-pressure UV lamp and the fluid is drinking water or treated wastewater.

11. An electronic ballast unit for controlling a UV lamp comprising a pair of heating cathodes having a discharge voltage ($U_D$), said electronic ballast unit equipped with a control algorithm for adjusting the UV power of the UV lamp via pulse-width-modulation by performing the steps of:

decreasing a current generated by the electronic ballast unit to a level ($I_{kmin}$);

increasing a voltage amplitude (U) generated by the electronic ballast unit above the discharge voltage ($U_D$) until a desired UV power level is reached; and with increasing the voltage amplitude (U) decreasing a pulse width (PW), generated by the electronic ballast unit until $PW_{min}$ is reached, wherein decreasing the current and increasing the voltage amplitude (U) generates an ineffective current-voltage-ratio in which excess current heats the cathode.

12. The electronic ballast unit of claim 11, wherein the operating voltage of the UV lamp has a frequency between 40 kHz and 80 kHz.

13. The electronic ballast unit of claim 12, wherein the operating voltage of the UV lamp has a frequency of about 65 kHz.

14. The electronic ballast unit of claim 11, wherein the voltage amplitude (U) is 110% to 180% of the discharge voltage ($U_D$) during a major part of the pulse width.

15. The electronic ballast unit of claim 14, wherein the voltage amplitude (U) is 135% to 150% of the discharge voltage ($U_D$) during a major part of the pulse width.

16. The electronic ballast unit of claim 11, wherein the UV lamp is a low-pressure UV lamp.

17. A system for disinfecting fluid by means of UV radiation, the system comprising:

at least one UV lamp for generating UV radiation, the at least one UV lamp comprising a pair of heating cathodes having a discharge voltage ($U_D$); and the electronic ballast unit of claim 11 configured for operating said at least one UV lamp.

18. The system of claim 17, wherein the at least one UV lamp is a low-pressure UV lamp.

19. The system of claim 17, wherein the fluid is drinking water or treated wastewater.

* * * * *